United States Patent [19]

Dace, Jr.

[11] 4,232,573

[45] Nov. 11, 1980

[54] SLIP PLIERS WITH LOCK

[76] Inventor: Marvin H. Dace, Jr., Rte. 3, Box 665, Friendswood, Tex. 77511

[21] Appl. No.: 1,382

[22] Filed: Jan. 8, 1979

[51] Int. Cl.[3] ..... B25B 7/04

[52] U.S. Cl. ..... 81/405; 81/410 R; 81/411

[58] Field of Search ..... 81/385–414, 81/315, 317–320, 322, 323, 341–342

[56] References Cited

U.S. PATENT DOCUMENTS

| | | | |
|---|---|---|---|
| 1,426,553 | 8/1922 | Cruickshank | 81/328 |
| 1,499,186 | 6/1924 | Murphy | 81/323 |
| 1,684,775 | 9/1928 | Meikirk | 81/415 |
| 2,727,417 | 12/1955 | Eifel | 81/416 |
| 3,176,551 | 4/1965 | Hansen | 81/341 |

FOREIGN PATENT DOCUMENTS

| | | | |
|---|---|---|---|
| 836928 | 4/1952 | Fed. Rep. of Germany | 81/411 |
| 257808 | 4/1949 | Switzerland | 81/394 |

*Primary Examiner*—James L. Jones, Jr.
*Attorney, Agent, or Firm*—Guy E. Matthews

[57] ABSTRACT

A device for retaining a set of slip-type pliers in functional adjustment is disclosed. The device comprises a shouldered dowel pin axially slidable between two positions, the first permitting freedom of adjustment between the two plier members, the second position retaining the plier members in functional adjustment while permitting freedom of use thereof. The dowel pin is retained in its second position by a spring mounted therewith and carried by one of the plier members. An alternative embodiment incorporates a modified pin pivotally connecting the two plier members in rotating relation with each other. This pin is spring mounted and includes a shoulder or cap which selectively engages each of a series of spaced counterbores within the adjusting slot of one of the plier members for retaining the plier members in functional adjustment with each other during use.

2 Claims, 5 Drawing Figures fig.1
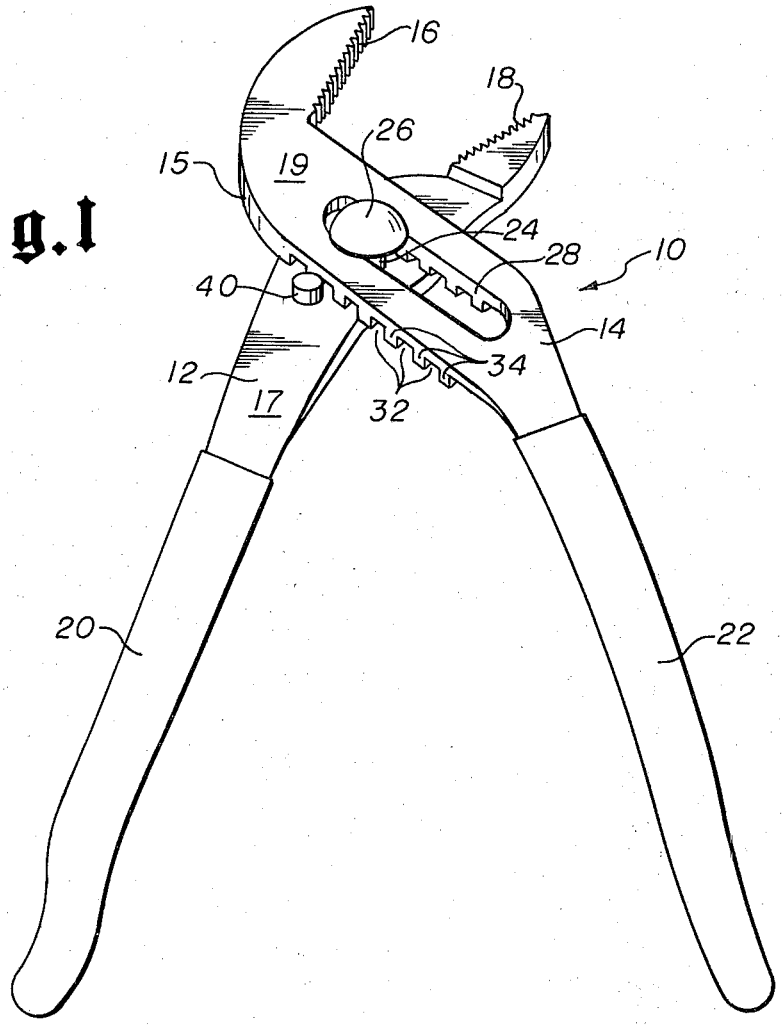
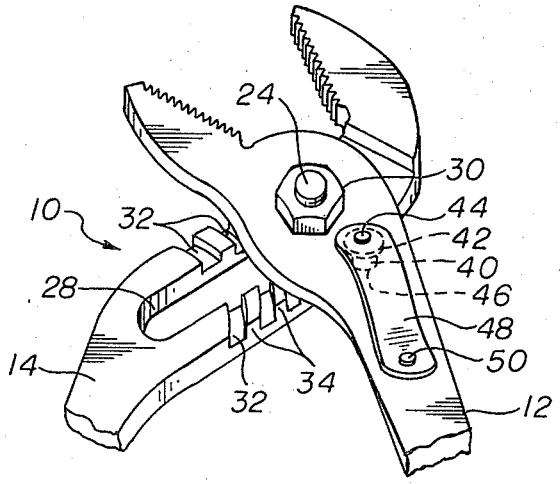
fig.2

SLIP PLIERS WITH LOCK

SUMMARY OF THE INVENTION

A device for retaining a set of slip-type pliers in functional adjustment is provided. The device comprises a spring-actuated locking pin that, in its "locking" position, retains the plier members in functional adjustment, and in a second position, permits the user to readjust the plier members to a different functional adjustment. A locking mechanism pin is spring loaded to be urged toward its "locking" position, and is manually depressed by the user in order to permit readjustment of the plier members.

FIELD OF THE INVENTION

The present invention relates generally to slip-type or other pliers having a mechanical adjustment whereby the "bite" size may be adjusted to a number of settings, and more specifically to a device to lock the pliers in one of these settings, thus preventing the pliers from changing functional adjustment until the user so desires.

DESCRIPTION OF THE PRIOR ART

Patents of interest disclosing pliers or wrenches are Kress, U.S. Pat. No. 2,444,135, disclosing a plier-type wrench having a worm-type adjustment; Blaine, U.S. Pat. No. 63,689, disclosing a wrench, adjustable by locating a setscrew through one of the plier members and into one of a plurality of countersinks in the other plier member; Brown, U.S. Pat. No. 142,143, disclosing a pliershaped pipe-tong having a setscrew type adjustment; and Marble, U.S. Pat. No. 528,755, disclosing adjustable blacksmith tong adjustable by mating one of a plurality of holes in a tong member with a hole in a second tong member and inserting a pivot pin therethrough.

As any frequent user of slip-type pliers of the present invention knows, such pliers are easily adjusted from one functional setting to another, and such easy adjustment from one position to another is a detriment because pliers lose their desired setting and become disengaged therefrom when placed down on a workbench or dropped, and as a rule require two hands to readjust the pliers back into their proper position. It should be pointed out that it is sometimes more difficult to readjust the pliers to their proper setting than it is to readjust from one desired position to another.

It is therefore an object of the present invention to provide a mechanism by which a set of slip pliers may be "locked" into proper position and remain in such position until the user manually disengages the lock and selects a new desired position for such pliers.

BRIEF DESCRIPTION OF THE DRAWINGS

Other objects and advantages of the invention will become apparent upon a careful reading of the following detailed description of the invention, the claims and the drawings, in which like reference characters are used throughout to denote like parts in the several views, wherein:

FIG. 1 is a perspective view of a pair of slip pliers incorporating the locking mechanism herein;

FIG. 2 is a partial perspective view of the opposite side of that of FIG. 1 showing the locking device and spring mechanism of the present invention;

The following invention will be described in connection with a preferred embodiment; it will be understood however that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
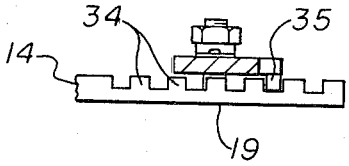
FIG. 5 is a partial vertical cross-sectional view of the slip-type pliers of FIG. 4, showing the guide ridge and guide channels.

Referring now to the drawings, a set of typical slip pliers, incorporating the present invention, is shown generally illustrated at 10. The pliers 10 comprise a first member 12, a second member 14, the members being held in rotational relation to each other by a pivot pin 24. The first member 12 includes a first gripping jaw 16 at one end thereof and a first elongated handle 20 at the opposite end thereof. Likewise the second member 14 includes a second gripping jaw 18 at one end thereof and a second elongated handle 22 at the opposite end thereof. As can be seen from the drawings, the two members rotate with respect to one another about the pivot pin 24 so that the gripping jaws 16 and 18 oppose one another and come together as the handles 20 and 22 are closed together. The amount of "bite", i.e. the distance between the gripping jaws 16 and 18 when the handles 20 and 22 are together, is determined by the location of the pivot pin 24 within a slot 28 of the second plier member 14. As shown in the drawings, the second plier member 14 includes spaced guide channels and guide walls or ridges, 32 and 34 respectively. The first member 12 of FIGS. 1 and 3 also includes a mating ridge 35 shown only in FIG. 5 for the embodiment of FIG. 3 but applicable also to the embodiment of FIG. 1 that selectively slides as desired by manual engagement within one of the desired guide channels 32 of the second member 14. The position of this first member guide ridge 35 within one of the various second member guide channels 32 determines the gripping size or "bite" of the pliers.

To adjust the pliers, the operator opens them by spreading the handles 20 and 22 and sliding the pivot pin 24 along the second member slot 28 until the first member guide ridge 35 mates with the proper second member guide channel 32. At this point, the pliers may be closed (the handles pulled toward each other) and used as desired.

A dowel member 40 is mounted within the first plier member 12 for movement transverse to the longitudinal axis of plier member 12, so that when the dowel member is in the position shown in FIG. 1, the dowel abuts the edge 15 of the second plier member 14 to retain the plier member in functional adjustment by enabling the first member guide ridge 35 to be retained in the desired channel 32 which prevents the pivot pin 24 from moving longitudinally within the slot 28 to thereby prevent loss of the functional adjustment or "bite". As shown in FIG. 2, the dowel 40 is held in place by a resilient means or spring means which urges the dowel or pin 40 to the position of FIG. 1 such that the pin normally extends outwardly from the face 17 of plier member 12. The dowel 40 also includes a shoulder 42 which retains the dowel in position within the plier first member 12 and limits travel of pin 40. The dowel 40 also includes a means 44 (shown in FIG. 2) for maintaining the spring and dowel in contact with each other. The spring 48 is attached to the first plier member 12 by a brad, screw, or the like 50 to maintain the spring 48 in tension relationship with dowel 40 to urge the dowel into its functional position shown in FIG. 1.

With the dowel 40 in position as shown in FIG. 1, the slip pliers 10 will maintain their present functional adjustment until the dowel is manually, depressed, as with the user's thumb, and the slip pliers readjusted in the conventional manner. Upon readjustment of the slip pliers 10, the spring 48 "snaps" the dowel 40 from its position shown FIG. 2 into its locking position shown in FIG. 1 to retain the second plier member 14 in functional adjustment until it is desired that the pliers be readjusted.

Figure 3:
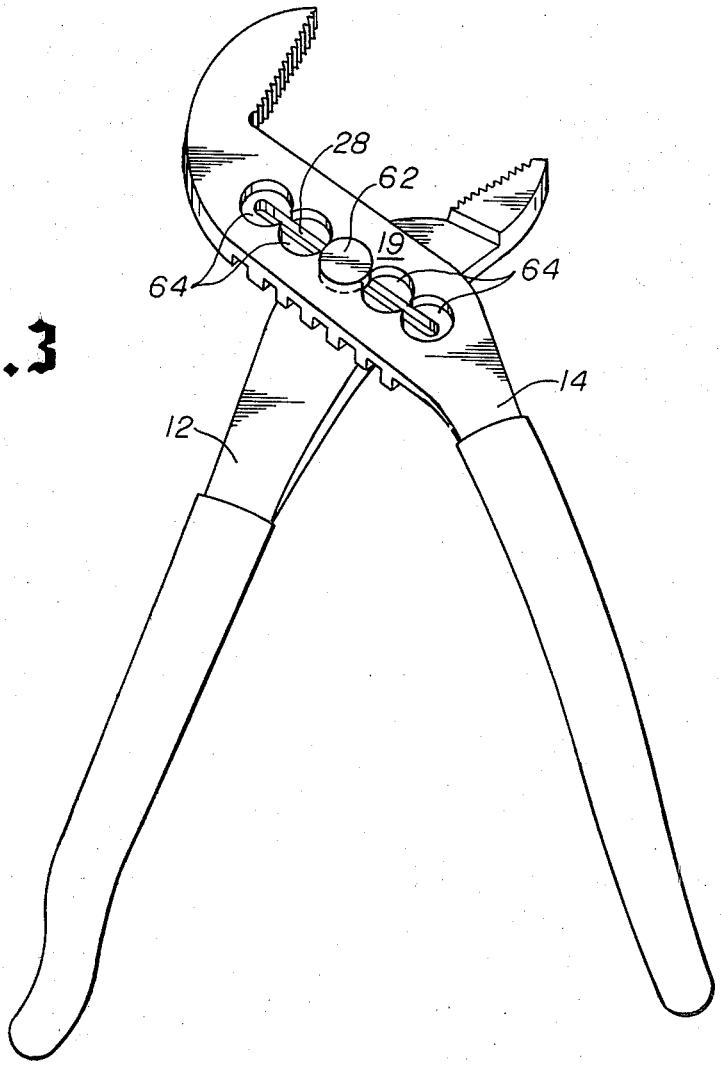
FIG. 3 is a perspective view of a pair of slip pliers incorporating an alternative embodiment of the present invention.
Figure 4:
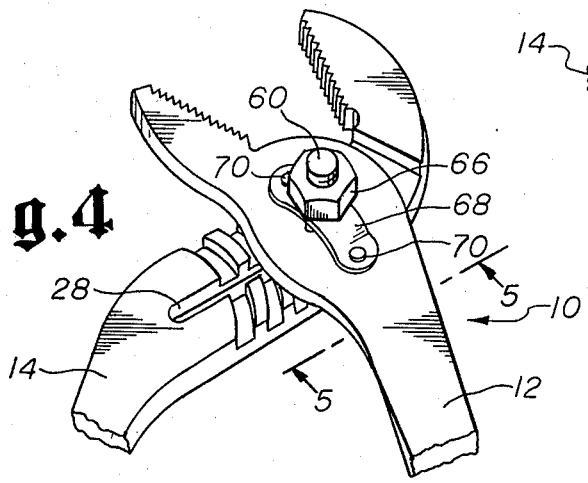
FIG. 4 is a partial perspective view of the opposite side of that shown in FIG. 3 showing the spring mechanism of the alternative embodiment of the present invention.

FIGS. 3 and 4 illustrate an alternative embodiment of the slip pliers 10 comprising the first plier member 12, second plier member 14 and a modified pivot pin 60 slidably mounted with the first plier member. As shown in FIG. 3, the modified pivot pin 60 includes an annular shoulder or cap 62 for retaining the second plier member 14 in position once adjusted. The second plier member 14 includes a slot 28 through which pin 60 slidably passes and includes a series of spaced holes 64 along the slot for receiving the shoulder or cap 62 of pin 60. From a study of FIG. 3, those skilled in the art will readily appreciate that, when in position as shown, the modified pivot pin cap 62 acts to retain the plier members 12 and 14 in functional adjustment, as in the preferred embodiment, by enabling the first member guide ridge 35 to be retained in the desired channel 32 which prevents pivot pin 60 from moving longitudinally within slot 28 to thereby prevent loss of the functional adjustment or "bite". So adjusted, the pliers 10 may be used many times carried about, laid down or even dropped, and still will maintain their proper adjustment.

As shown in FIG. 4, the modified pivot pin 60 is retained in its second "locking" position by the action of a resilient means or spring 68 acting on nut 66 to urge the pin into this second position. Spring 68 is held in place by two brads, screws, etc. 70 which prevent the spring from rotating as the pliers 10 are used or adjusted.

To adjust the alternative embodiment pliers 10 to a different position or "bite", the user depresses the modified pivot pin 60 from the nut side (top side as shown in FIG. 4) until the shoulder or cap 60 is disengaged from the spaced holes 64 and otherwise clears the exterior surface 19 of the second plier member 14. With the pin 60 so extended, plier member 14 may slide along the first member 12 until the pliers are in proper readjustment. At this point, the user releases manual depression force against the nut side of modified pin 60, permitting the pin cap 62 to engage one of the second member holes 64. The pliers 10 may now be used as desired, carried about, etc., and will retain this particular adjustment until the user desires to readjust the pliers using the aforementioned procedure.

Thus, it is apparent that there has been provided in accordance with the invention, a locking device for slip-type pliers that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and scope of the appended claims.

The invention having been described, what is claimed is:

1. A new and improved set of slip type pliers, comprising:

two pivotally connected plier members, each member having an opposing gripping jaw and an elongated handle at the opposite end thereof;

a pivot pin mounted to the first plier member about which the second plier member rotates;

the second plier member having a slot therein for receiving the pivot pin to thereby permit the second plier member to slide relative to the first plier member therein enabling the second plier member to be manually adjusted about the pivot pin for rotation and positioning of such second plier member jaws relative to the jaws of said first plier member;

means for locking said pivot pin relative to said slot wherein said jaws may be moved relative to each other to enable gripping of a desired object only in one fixed position and wherein said pivot pin is prevented from sliding in said slot to enable said jaws to be maintained in said one fixed position, means for unlocking said pivot pin relative to said slot, said pivot pin being free to slide within said slot to enable said gripping jaws to be readjusted to maintain said jaws in a different position;

said locking means being a dowel slidably positioned within the first plier member, said dowel being slidable between a first position for preventing said pivot pin from sliding within said slot to enable said jaws to be maintained in one fixed position, and a second position for releasing the plier members to enable said gripping jaws to be readjusted to maintain said jaws in a different position, said locking means including a resilient means mounted to said dowel for urging said dowel into its first position for retaining the plier members in a preset functional adjustment.

2. A new and improved set of slip type pliers, comprising:

two pivotally connected plier members, each member having an opposing gripping jaw and an elongated handle at the opposite end thereof;

a pivot pin mounted to the first plier member about which the second plier member rotates;

the second plier member having a slot therein for receiving the pivot pin to thereby permit the second plier member to slide relative to the first plier member therein enabling the second plier member to be manually adjusted about the pivot pin for rotation and positioning of such second plier member jaws relative to the jaws of said first plier member;

means for locking said pivot pin relative to said slot wherein said jaws may be moved relative to each other to enable gripping of a desired object only in one fixed position and wherein said pivot pin is prevented from sliding in said slot to enable said jaws to be maintained in said one fixed position, means for unlocking said pivot pin relative to said slot, said pivot pin being free to slide within said slot to enable said gripping jaws to be readjusted to maintain said jaws in a different position, said locking means being a pivot pin about which said two plier members rotate relative to each other, said pivot pin being slidable between a first position for retaining the plier members in a preset functional adjustment, and a second position for releasing the plier members for readjustment to a different functional adjustment, said pivot pin including an annular shoulder thereon and wherein the second plier member includes a plurality of holes spaced along the slot for receiving said pivot pin annular shoulder for retaining the plier members in adjustment with each other, said locking means including a resilient means mounted with said slidable pivot pin for urging said pin into its first position for retaining the plier members in a preset functional adjustment.

* * * * *